US009728109B1

(12) United States Patent
Weisburn

(10) Patent No.: US 9,728,109 B1
(45) Date of Patent: Aug. 8, 2017

(54) SIGNAGE SYSTEM, A DISPLAY SIGN ASSEMBLY INCORPORATING THE SAME AND A METHOD OF USE THEREOF

(71) Applicant: INTERIOR GRAPHIC SYSTEMS, LLC, North Canton, OH (US)

(72) Inventor: James T. Weisburn, North Canton, OH (US)

(73) Assignee: Interior Graphic Systems, LLC, North Canton, OH (US)

( * ) Notice: Subject to any disclaimer, the term of this patent is extended or adjusted under 35 U.S.C. 154(b) by 0 days.

(21) Appl. No.: 15/296,377

(22) Filed: Oct. 18, 2016

(51) Int. Cl.
*G09F 7/18* (2006.01)

(52) U.S. Cl.
CPC ..... *G09F 7/18* (2013.01)

(58) Field of Classification Search
CPC ..... G09F 7/18; G09F 2007/1843; G09F 2007/1891; G09F 7/06
See application file for complete search history.

(56) References Cited

U.S. PATENT DOCUMENTS 1,455,103 A * 5/1923 Berry ..... G09F 7/18 40/606.14
2,604,712 A * 7/1952 Le Blanc ..... G09F 7/10 40/618
3,258,870 A * 7/1966 Offenhauer ..... G09F 7/06 40/622
4,275,516 A * 6/1981 Lane ..... G09D 3/02 40/107
5,230,175 A * 7/1993 Follis ..... G09F 15/0006 40/605
5,343,646 A * 9/1994 Cobb ..... G09F 7/08 40/585
5,428,914 A * 7/1995 Whitehouse ..... G09F 7/06 40/594
5,511,331 A * 4/1996 Morosini ..... G09F 3/04 40/316
5,555,660 A 9/1996 Whitehouse et al.
6,196,758 B1 * 3/2001 Scarborough ..... F16B 21/09 403/109.3
6,484,985 B1 * 11/2002 Heltzer ..... G09F 7/18 248/220.43
7,413,371 B2 * 8/2008 Arnold ..... B60R 22/18 403/315
2007/0278355 A1 * 12/2007 Watson ..... B29C 45/14 246/246

* cited by examiner

*Primary Examiner* — Gary C Hoge
(74) *Attorney, Agent, or Firm* — Sand & Sebolt

(57) ABSTRACT

A signage system and a method of using the same. The system includes a base plate with front and rear surfaces; one or more signs engageable with the base plate; each sign having a rear surface positionable adjacent the front surface of the base plate; a boss extending outwardly from the rear surface of the sign or a front surface of the base plate; and an aperture defined in the other of the rear surface of the sign or the front surface of the base plate; wherein the boss is received in the aperture; and wherein the sign is moveable relative to the base plate between an unlatched position and a latched position; and when in the latched position the boss is not removable from the aperture. A locking member is engageable with the base plate to selectively prevent relative movement between the signs and the base plate.

22 Claims, 10 Drawing Sheets

SIGNAGE SYSTEM, A DISPLAY SIGN ASSEMBLY INCORPORATING THE SAME AND A METHOD OF USE THEREOF

BACKGROUND OF THE INVENTION

Technical Field

This invention relates generally to signs for displaying information. More particularly this invention is directed to displays signs that may be mounted on a support surface such as a building wall and where the information on the sign needs to be changed from time to time. Specifically, this invention relates to a base plate that is mountable on a support surface and a plurality of signs removably engageable with the base plate by inserting a boss on the sign into an aperture in the base plate and then sliding the sign relative to the base plate to latch the sign to the base plate.

Background Information

Office buildings, doctor's offices, hospitals and other locations frequently install signs that display information that is relevant to visitors and customers. For example, an office building may includes a sign that display a list of the companies located in that building and where they are located within the building. From time to time is may be necessary to remove the name of one company from the display sign and replace it with the name of another company. It would be unnecessarily expensive to have to redo the entire display sign in order to replace a single company name. A number of different ways have been utilized in the past to make these types of changes to signs but many of the methods result in the end product looking less professional than desirable.

SUMMARY

There is therefore a need in the art for an improved signage system that displays multiple signs thereon and that allows for quick and easy replacement of individual signs and results in the end product being aesthetically pleasing.

A signage system and a method of using the same. The system includes a base plate having a front surface and a rear surface; one or more signs engageable with the base plate; each sign having a rear surface that is positionable adjacent the front surface of the base plate; a boss extending outwardly from the rear surface of the sign or a front surface of the base plate; and an aperture defined in the other of the rear surface of the sign or the front surface of the base plate; wherein the boss is received in the aperture; and wherein the sign is moveable relative to the base plate between an unlatched position and a latched position; and when the sign is in the latched position the boss is not removable from the aperture. A locking member is engageable with the base plate to selectively prevent relative movement between the signs and the base plate.

In one aspect, the invention may provide a signage system comprising a base plate having a front surface and a rear surface; a sign having a rear surface that is positionable adjacent the front surface of the base plate; a boss extending outwardly from the rear surface of the sign or a front surface of the base plate; and an aperture defined in the other of the rear surface of the sign or the front surface of the base plate; wherein the boss is received in the aperture; and wherein the sign is moveable relative to the base plate between an unlatched position and a latched position; and when the sign is in the latched position the boss is not removable from the aperture.

In another aspect, the invention may provide a method of displaying a sign; comprising providing a signage system comprising a base plate and a sign for display; wherein one of the base plate and the sign has a boss that extends outwardly therefrom and the other of the base plate and the sign defines an aperture therein and through which the boss is able to pass; mounting the base plate on a support surface; inserting the boss into the aperture; moving the sign relative to a front surface of the base plate; and latching the sign to the base plate.

In another aspect, the invention may provide a display sign assembly comprising a plate member having a front surface and a rear surface; where the rear surface is adapted to be positioned on a support surface; a plurality of signage systems being selectively engageable on the front surface of the plate member; wherein each signage system comprises a base plate having a front surface and a rear surface; a sign having a rear surface that is positionable adjacent the front surface of the base plate; a boss extending outwardly from the rear surface of the sign or a front surface of the base plate; and an aperture defined in the other of the rear surface of the sign or the front surface of the base plate; wherein the boss is received in the aperture; and wherein the sign is moveable relative to the base plate between an unlatched position and a latched position; and when the sign is in the latched position the boss is not removable from the aperture; and wherein the plate member defines a plurality of apertures therein and the base plate of each signage system defines a plurality of bosses thereon; and wherein each signage system is latched to the plate member by inserting the plurality of bosses on the base plate thereof through the plurality of apertures defined in the plate member and then moving the base plate relative to the plate member to move the base plate from an unlatched position to a latched position.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Referring to FIGS. 1-12, there is shown a signage assembly in accordance with an aspect of the present invention, generally indicated at 10. Assembly 10 is configured to be removably mounted upon an exterior surface 12*a* of a support surface 12 such as a wall, a door, or any other surface suitable for displaying signs thereon. The support surface 12 may be vertical such as a wall, or horizontal or angled.

Assembly 10 comprises a back plate 14, a plurality of individual signs 16, 18, 20, 22, 24, 26 that are engageable with back plate 14; and a locking member 28 that secures signs 16-26 to back plate 14. Signs 16-26 and locking member 28 are movable relative to back plate 14 as will be described hereafter and are selectively latchable and lockable relative thereto.

Figure 1:
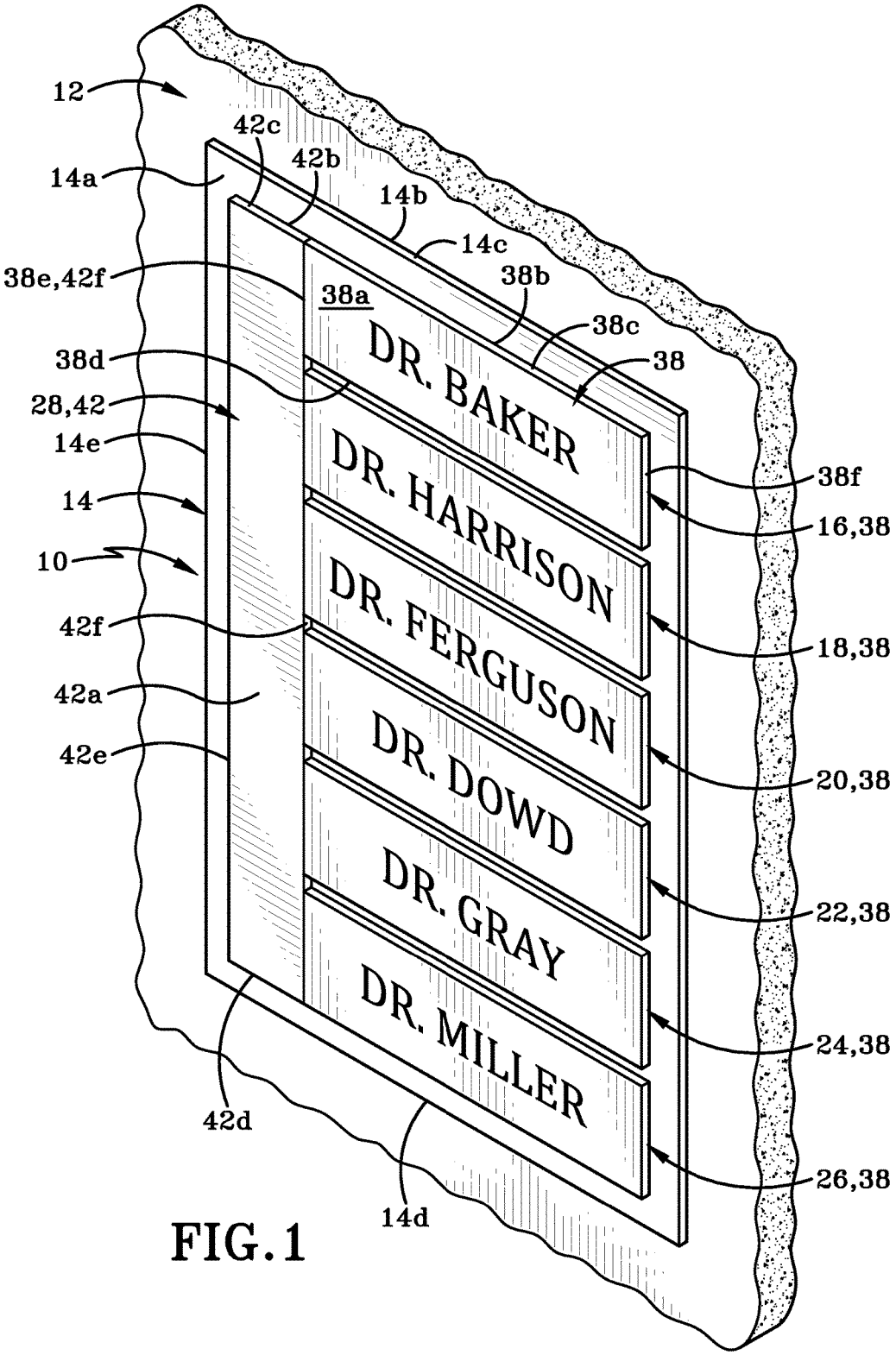
FIG. 1 is a front perspective view of the signage assembly in accordance with an aspect of the present invention shown mounted on a wall and displaying several signs thereon.
Figure 2:
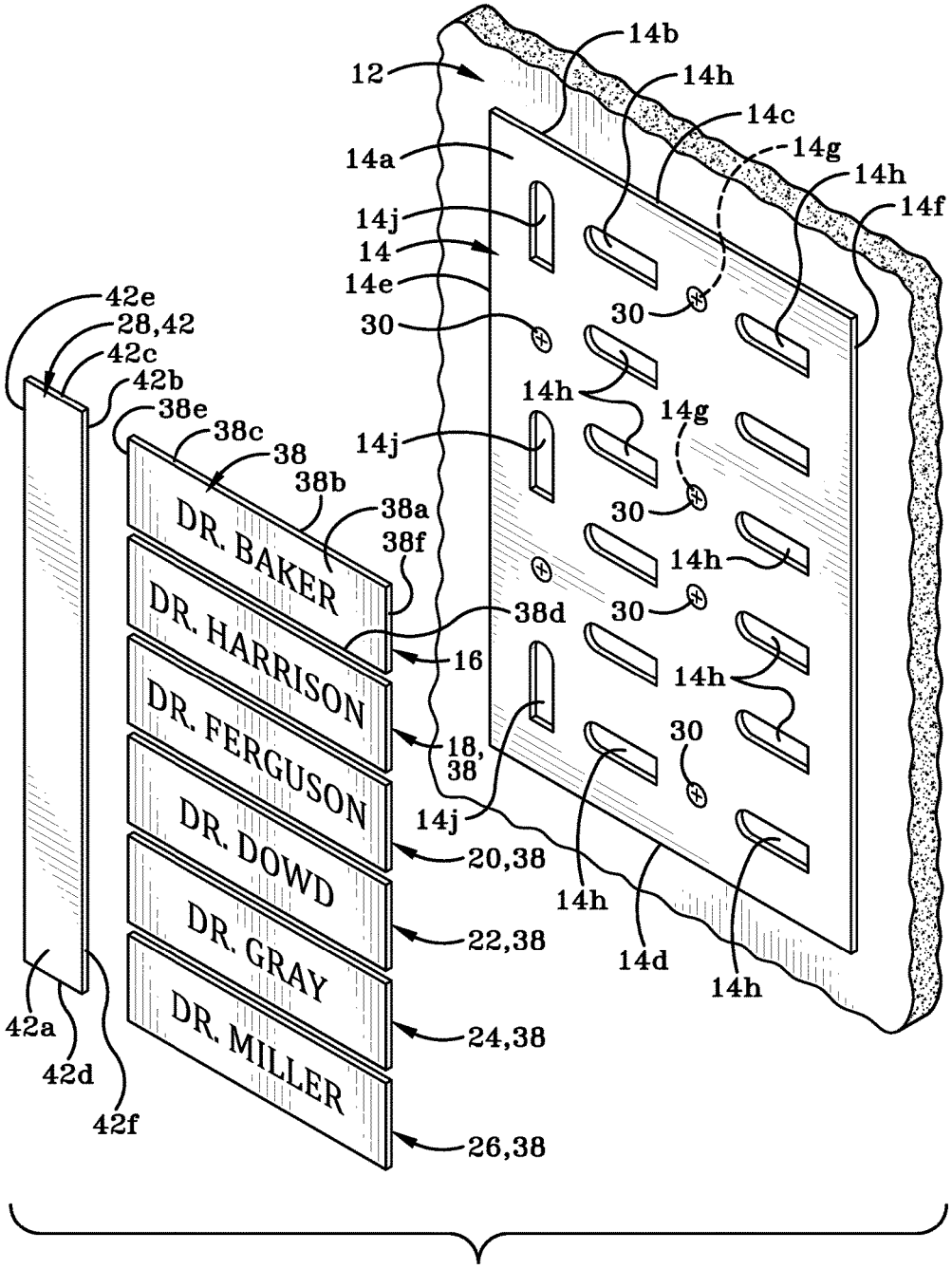
FIG. 2 is an exploded front perspective view of the signage assembly of FIG. 1.
Figure 3:
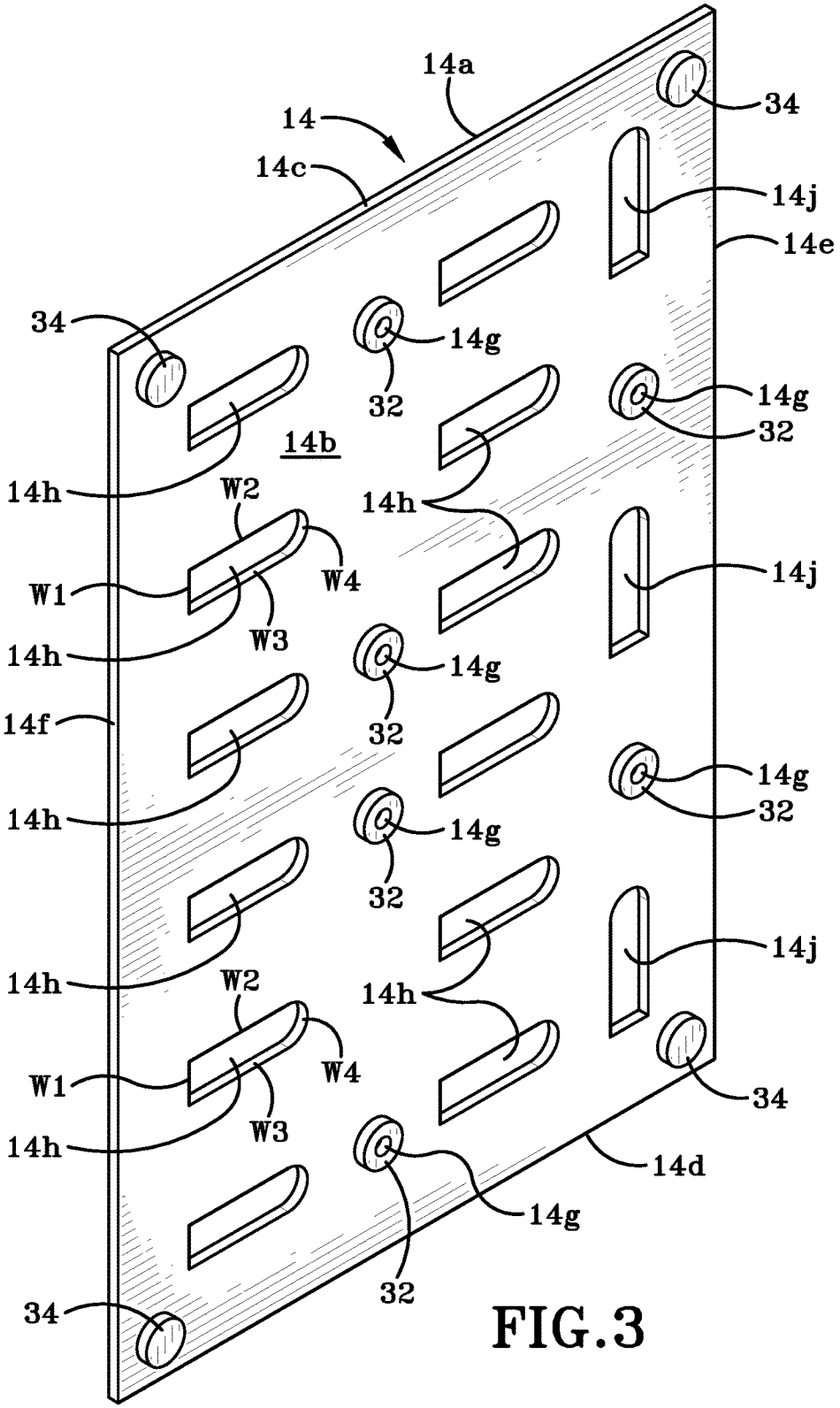
FIG. 3 is a rear perspective view of the back plate of the signage assembly.

Referring to FIG. 2, back plate 14 may be a generally rectangular member that has a front surface 14*a*, a rear surface 14*b* (FIG. 3), a top edge 14*c*, a bottom edge 14*d*, a left side edge 14*e* and a right side edge 14*f*. A mounting assembly is provided to secure back plate 14 to a suitable support surface 12 such as a wall. The mounting assembly may comprise any components that will secure base plate 14 to support surface 12. By way of example only, a plurality of holes 14*g* is defined in back plate 14, where holes 14*g* extend between front and rear surfaces 14*a*, 14*b*. Fasteners 30 extend through holes 14*g* to secure back plate 14 to support surface 12. FIG. 3 shows that mountings 32 may be provided on rear surface 14*b* and extend outwardly for a distance therefrom. Mountings 32 may be integrally formed with fasteners 30 or may be separate components that engage fasteners 30 or may be completely independent and unengaged with fasteners 30. In this latter instance, mountings 32 may be secured in other ways rear surface 14*b*. Mountings 32 may be positioned so as to circumscribe holes 14*g* or may be positioned in other locations on rear surface 14*b*. Mountings strengthen the area of base plate 14 through which fasteners 30 will be received. Mountings 32 serve an additional purpose in that they act as spacers between rear surface 14*b* of base plate 14 so that a latching and locking mechanism can be employed, as will be further described herein. A plurality of rubber stops 34 may also be provided on rear surface 14*b*. Stops 34 may be positioned at any location but proximate each corner of the rectangular back plate 14 may be suitable for keeping rear surface 14*b* a distance from exterior surface 12*a* of support surface 12. Stops 34 may aid in ensuring that base plate 14 is adequately supported on support surface 12. Stops 34 may be omitted. Mountings 32 and stops 34 may be provided to ensure a gap 36 (FIG. 9) is defined between rear surface 14*b* of back plate 14 and exterior surface 12*a* of support surface 12. The purpose of gap 36 will be described later herein. It will be understood that other types of mounting assembly may be used to secure base plate 14 to support surface. For example, if the signage system 10 is to be a permanent fixture on support surface 12 an adhesive may be used to secure base plate 14 to support surface 12. The term "mounting assembly" should be understood to cover any and all components that are usable to secure base plate 14 to support surface 12 in either of a temporary or permanent fashion.

In accordance with an aspect of the present invention, back plate 14 may define a plurality of apertures 14*h* therein. Apertures 14*h* may be of any suitable shape and size and are spaced at intervals on back plate 14. Apertures 14*h* as illustrated herein are generally rectangular and are defined by one straight end wall, indicated in FIG. 8 as end wall "W1", a pair of opposed side walls "W2" and "W3" extending outwardly from opposite ends of end wall "W1"; and a curved end wall "W4" that is located opposite end wall "W1". Each aperture 14*h* has a length "L" defined between ends walls "W1" and "W2" and a width "W" defined between side walls "W2" and "W3". Apertures 14*h* may be arranged in one or more vertically oriented columns (in the attached figures—two columns); where the columns extend from proximate top end 14*c* and bottom end 14*d* of back plate 14. Apertures 14*h* may also be arranged in aligned rows where each row is horizontally oriented and extends from proximate first side 14*e* to proximate second side 14*f*. These apertures 14*h* may all have generally the same orientation, with the end walls "W1" all being vertically aligned with each other and with the curved end walls "W4" all being vertically aligned with each other.

In accordance with another aspect of the invention, one column of apertures includes holes 14*j* that are oriented generally at right angles to the orientation of the rest of the apertures 14*h* on back plate 14. Holes 14*j* are substantially identical in shape and size to apertures 14*h* and therefore have a length "L" and a width "W". Holes 14*j* are vertically aligned one below the other and are spaced a distance apart from each other.

Figure 4:
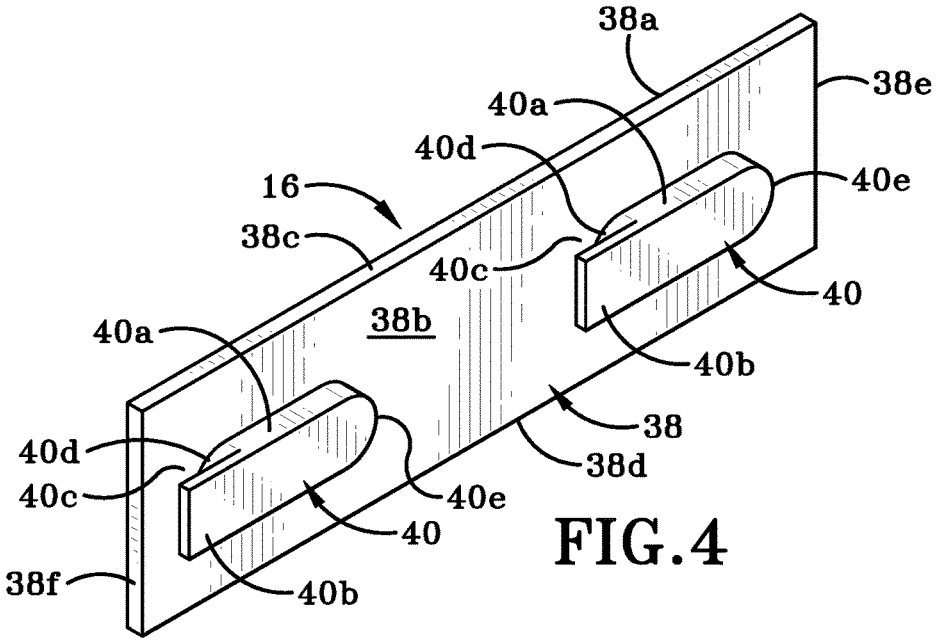
FIG. 4 is a rear perspective view of a sign for engagement with the back plate.
Figure 5:
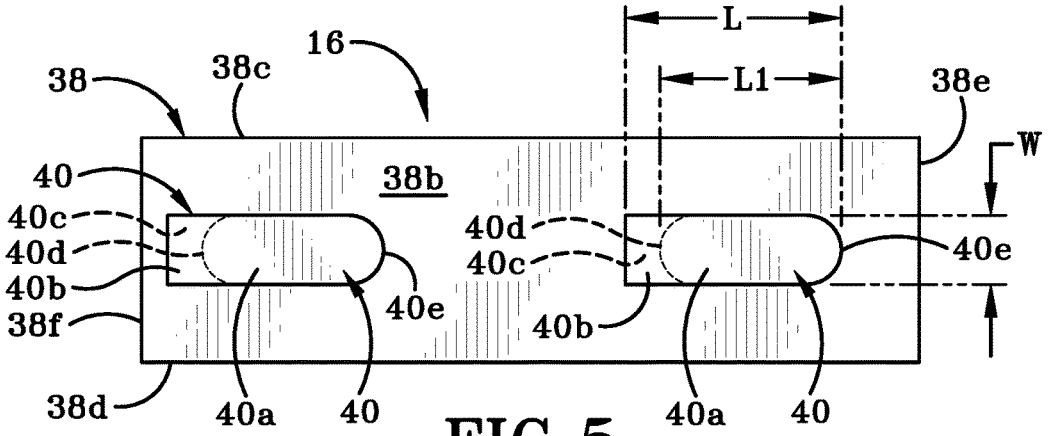
FIG. 5 is a rear elevational view of the sign of FIG. 4.
Figure 6:
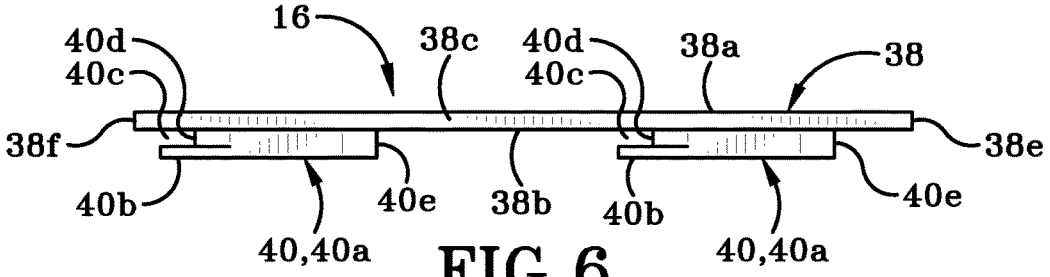
FIG. 6 is a top view of the sign of FIG. 4.
Figure 7:
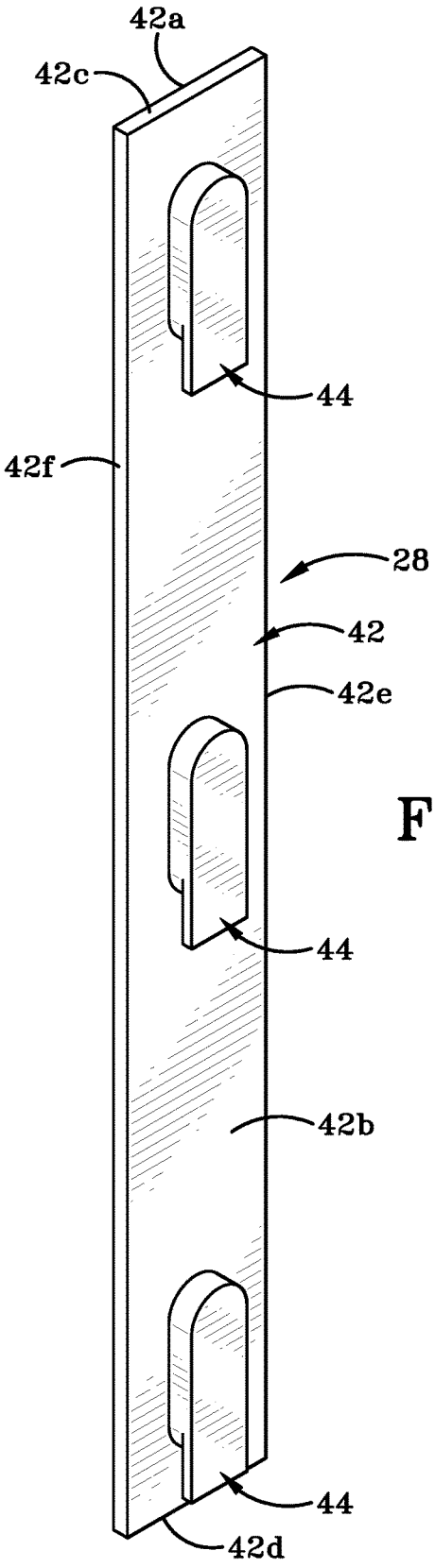
FIG. 7 is a rear perspective view of a locking member for use in the signage assembly of FIG. 1.

Each of the signs 16-26 may be substantially identical. Signs 16 and 22 will be described and discussed below in greater detail but the description applies to all of the other signs 18, 20, 24 and 26. Referring to FIGS. 4-6, signs 16 and 22 each include a base plate 38 that may be generally rectangular in shape. Base plate 38 may have a front surface 38*a*, a rear surface 38*b*, a top edge 38*c*, a bottom edge 38*d*, a left side edge 38*e* and a right side edge 38*f*. Front surface 38*a* may include suitable indicia, i.e., words, letters, figures, etc. So, for example, the front surface 38*a* may have the words "DR. BAKER" or "DR. DOWD", imprinted, marked, painted, engraved or otherwise applied thereto.

One or more bosses 40 are provided on rear surface 38*b* of base plate 38. Each boss 40 includes a first region 40*a* that extends outwardly from rear surface 38*b* of base plate 38, and a second region that extends outwardly from first region 40*a*. A gap 40*c* (FIG. 6) is defined between second region 40*b* and rear surface 38*b*. Gap 40*c* is dimensioned so as to receive a portion 14*k* (FIG. 10 of the wall of base plate 14 therein when the sign is moved from an unlatched position to a latched position as will be later described herein. When the sign is moved relative to base plate 14, flange 40*b* on boss 40*a* is caused to overlap portion 14*k* and capture portion 14*k* in gap 40*c*.

Boss 40 further includes a first curved surface 40*d* (FIGS. 5 & 6) and a second curved surface 40*e*. A first side and a second side extend between aligned ends of first curved surface 40*d* and second curved surface. These first and second sides are located opposite each other and first and second curved surfaces 40*d*, 40*e* are located opposite each other. First curved surface 40*e* may act as a stop to limit travel of sign 16 when sign 16 is moved from the unlatched position to the latched position. First curved surface 40*d* contacts the part of base plate 14 that defines the straight end of aperture 14*h*. This straight end is designated by the reference number "W1 in FIG. 8. The curvature of second curved surface 40*e* is substantially identical to the curvature of wall "W2" so that boss 40 is readily and easily received within aperture 40 when sign 16 is engaged with base plate.

FIG. 6 shows that second region 40*b* forms a flange that extends outwardly for a distance from first region 40*a* and projects over a section of the rear surface 38*b* of sign 16. Second region 40*b* extends outwardly beyond curved first end 40*d* for a distance. The outermost region of each boss 40 (i.e., the outermost surface that is located remote from rear surface 38*b* and includes flange 40*b* is substantially the same shape and size as apertures 14*h* on back plate 14. Each sign 16-26 may be provided with one, two (or more) bosses 40. If two bosses 40 are provided then the bosses are spaced the same distance apart as are apertures 14*h* on back plate 14. The bosses on each sign 16-26 are aligned laterally with each other and are oriented with the flanges 40*b* thereof extending in the same direction outwardly from the first regions 40*a* thereof. The provision of two bosses 40 ensures that sign 16 is less likely to want to rotate because of the action of gravity of on sign 16.

Boss 40 has a length "L" and a width "W" that is substantially identical to the length "L" and width "W" of apertures 14*h*. The region of boss 40 closest to rear surface 38*b* that extends between curved ends 40*d* and 40*e* is of the same width "W" as one of the apertures 14*h* but the length between first curved end 40*d* and second curved end 40*e*, indicated in FIG. 6 as length "L!", is smaller than length "L" of aperture 14*h*.

Figure 8:
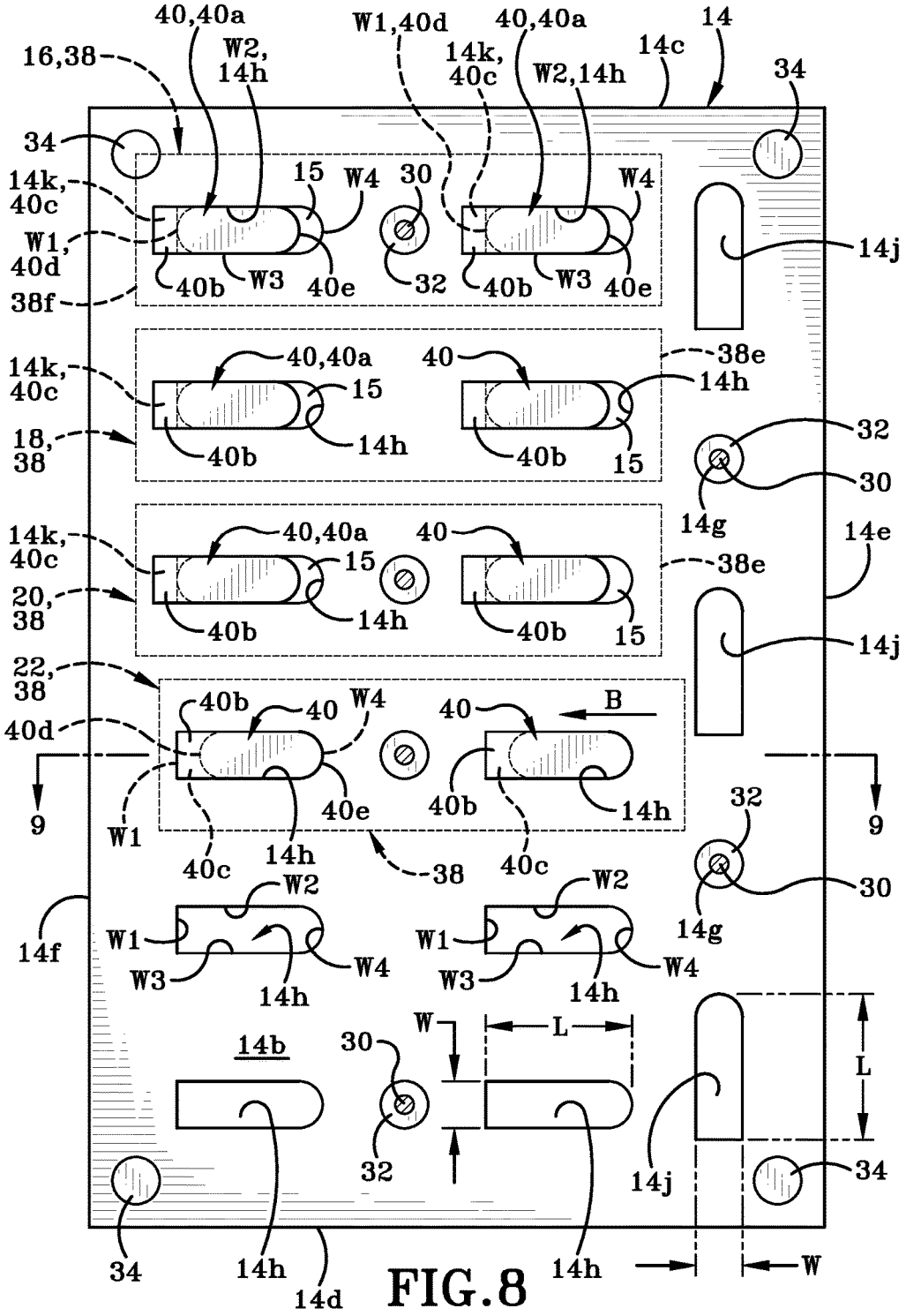
FIG. 8 is a rear elevational view of the back plate with several individual signs engaged therewith, with some of the individual signs being in a latched position and one sign being in an unlatched position; and yet other parts of the back plate being free of individual signs.

Sign 22 is shown engaged with back plate 14 in FIG. 8. In order to accomplish this engagement, the two bosses 40 on sign 22 are inserted through a pair of complementary horizontally aligned apertures 14*h* on back plate 14 and sign 22 is pushed inwardly toward base plate 14 in the direction indicated by arrow "A" in FIG. 9. Because of the complementary shape and size of bosses 40 relative to the associated apertures 14*h*, sign 22 may be selectively and readily inserted into apertures 14*h* in the direction of arrow "A" or withdrawn therefrom in the opposite direction to arrow "A".

Figure 12:
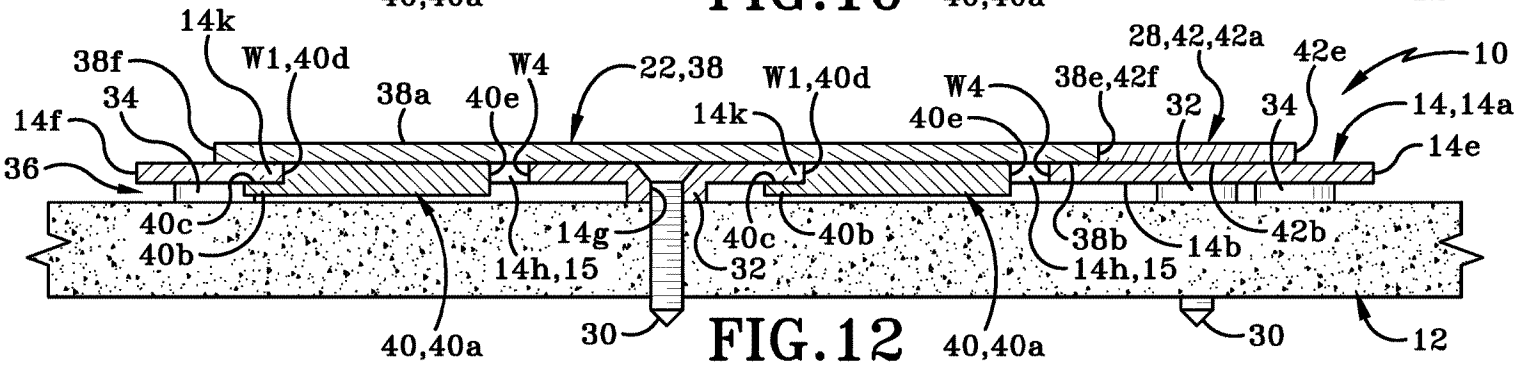
FIG. 12 is a cross-section of the back plate and an individual sign taken along line 12-12 of FIG. 11.
Figure 11:
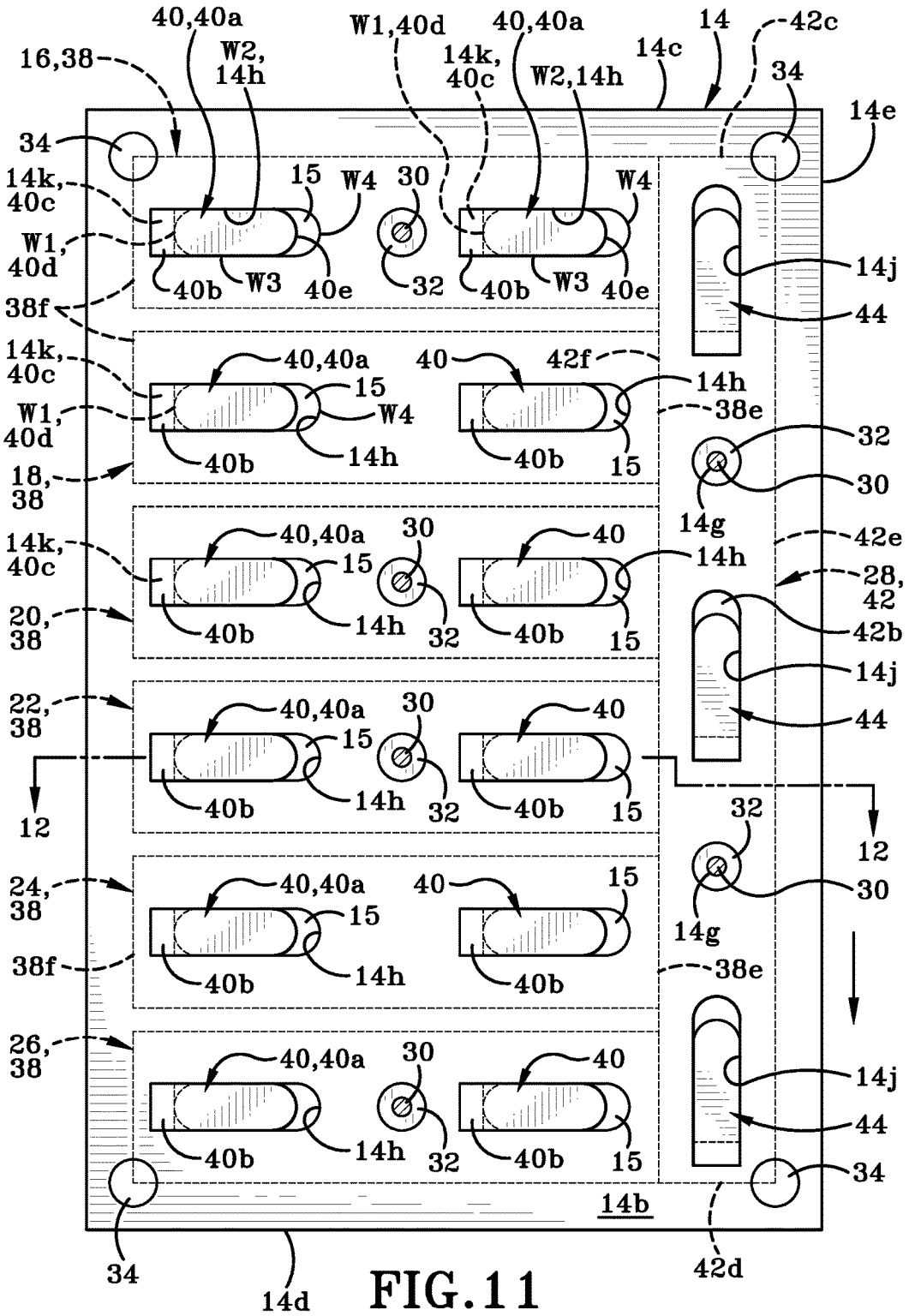
FIG. 11 is a rear elevational view of the back plate with a plurality of individual signs engaged therewith with all the individual signs in a locked position and showing a locking member in an unlocked position.

The sign 22 in FIG. 8 is shown in an unlatched or "at rest" position. In order to secure sign 22 to base plate 14 it is necessary to move sign 22 from the unlatched position (FIGS. 8 & 9) to a latched position (FIGS. 12 & 10). This latching is accomplished by moving sign laterally relative to base place 14 in the direction indicated by arrow "B" (FIG. 10). This lateral motion causes the second region 40*b* of boss 40 to slide laterally behind a section 14*k* (FIGS. 9 & 10) and to overlap the same. (Section 14*k* is part of the wall of base plate 14 that surrounds and defines aperture 14*h*.) Because of this overlapping of second region 40*b* and back plate 14, plate 22 can no longer be moved in the opposite direction to arrow "A". A region of aperture 14*h*, identified in FIGS. 8 and 10 is visible when sign 22 is latched to base plate 14. The visible region of aperture 14*h* is identified in these figures by the reference number 15. All latched signs 16-26 include this visible region 15 of the associated aperture 14*h*.

Figure 9:
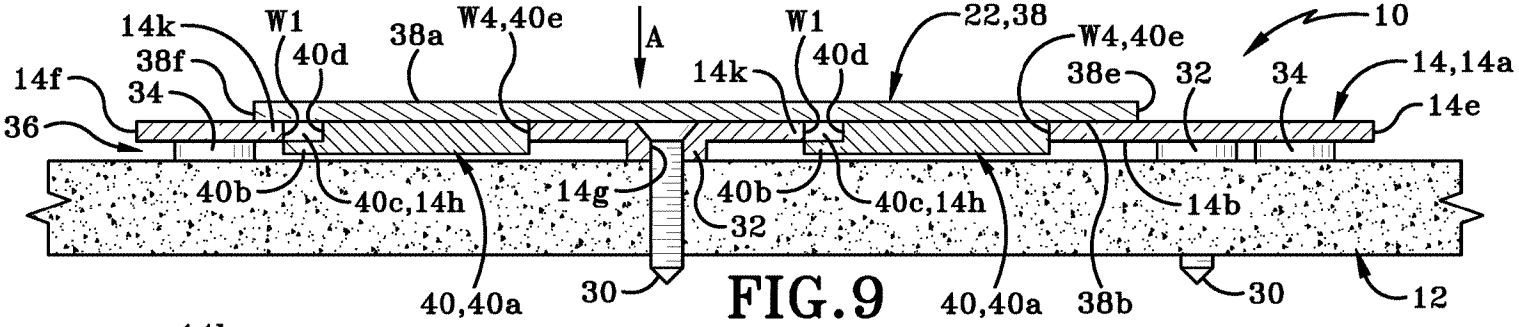
FIG. 9 is a cross-sectional view of a sign engaged with the back plate taken along line 9-9 of FIG. 8 and showing the sign in an unlatched position.
Figure 10:
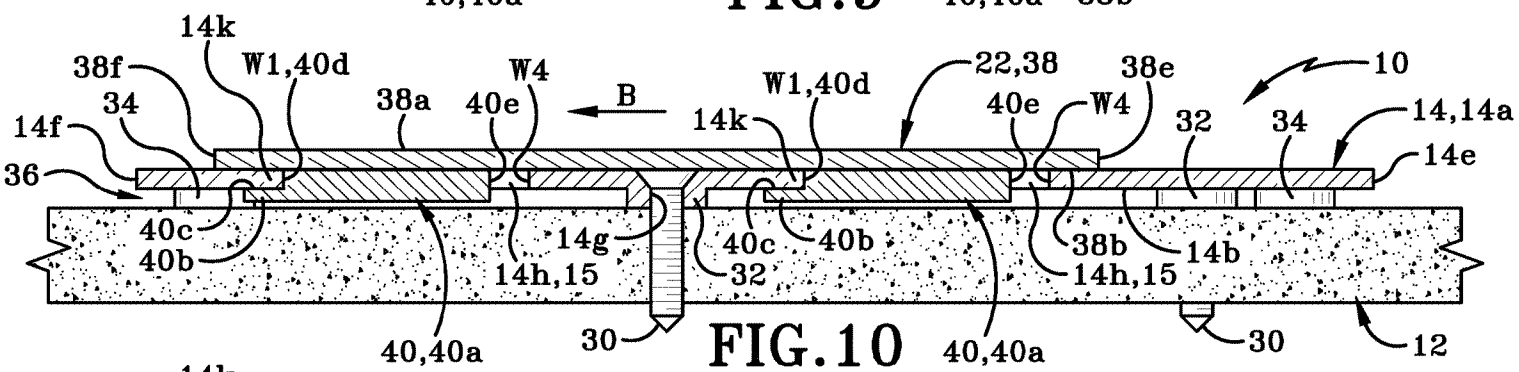
FIG. 10 is a cross-sectional view of the sign engaged with the back plate taken along line 9-9 but where the sign is moved to a latched position.

If it is desired to remove sign 22 from its engagement with back plate 14, the sign 22 must be unlatched by moving the sign laterally in the direction opposite to arrow "B" in FIG. 9. This motion causes second region 40*b* of each boss 40 on sign 22 to cease overlapping section 14*k* of base plate 14. When back in the unlatched position shown in FIG. 8, sign 22 may be disengaged from base place 14 simply by pulling it outwardly away therefrom in the opposite direction to arrow "A". This motion withdraws bosses 40 from apertures 14*h* in base plate 14.

Signs 16-26 may move laterally relative to base plate 14 because of the presence of gap 36 between rear surface 14*b* of base plate 14 and exterior surface 12*a* of support surface 12. Gap 36 is of a sufficient size to enable bosses 40 to move laterally therein and between exterior surface 12*a* and base plate 14.

Since, signs 16-26 may readily slide laterally relative to base plate 14 in the direction of arrow "B" or opposite thereto, it may be necessary to provide a mechanism for preventing this lateral motion. There may therefore be provided a locking member 28 that is of a similar construction to signs 16-22. Locking member 28 includes a bottom plate 42 that includes a front surface 42*a*, a rear surface 42*b*, a top edge 42*c*, a second edge 42*d*, a left side wall 42*e*, and a right side wall 42*f*. A plurality of locking bosses 44 extend outwardly from rear surface 42*b*. Locking bosses 44 are substantially identical to bosses 40 and are configured to be received in holes 14*j* defined in base plate 14. As such, each locking boss 44 includes a first region 44*a* that extends outwardly from rear surface 42*b* of bottom plate 42. A second region 44*b* of each locking boss 44 extends for a distance outwardly from one curved end of first region 44*a*.

Locking member 28 is installed in much the same way as each sign 16-26. Firstly, locking bosses 44 are inserted through holes 14*j* and bottom plate 44 is pushed inwardly (in a similar manner to arrow "A") and then bottom plate 44 moves, under influence of gravity, downwardly towards bottom edge 14*d* of base plate 14. This motion causes second region 44*b* of each locking boss 44 to slide under a region of base plate (similar to region 14*k*). At this point, there is interlocking engagement between locking member and base plate 14. The positioning of locking member 28 is such that when locking member 28 is secured to base plate 14 (as shown in FIG. 9), signs 16-26 cannot be moved laterally in order to unlatch them. Consequently, when locking member 28 is engaged with base plate 14, none of the signs 16-26 can be moved or removed from engagement with base plate 14. Removal of locking member 28 is accomplished by sliding locking member 28 upwardly toward top end 14*c* of base plate 14 and then pulling locking member 28 outwardly away from front surface 14*a* so that bosses 42 slide out of holes 14*j*.

Figure 13:
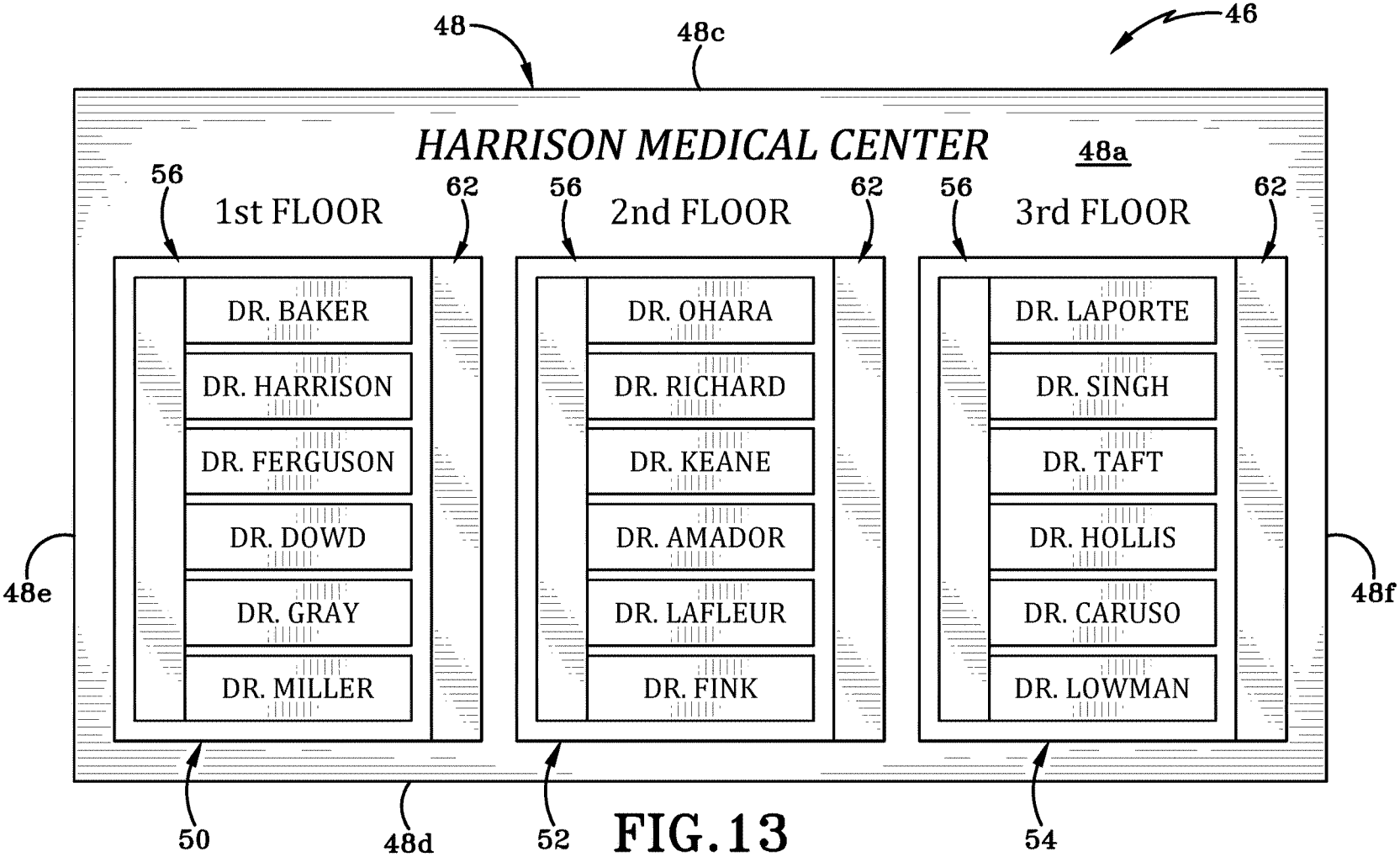
FIG. 13 is a front elevational view of a display sign rover in accordance with an aspect of the invention showing several individual signage assemblies engaged therewith.
Figure 14:
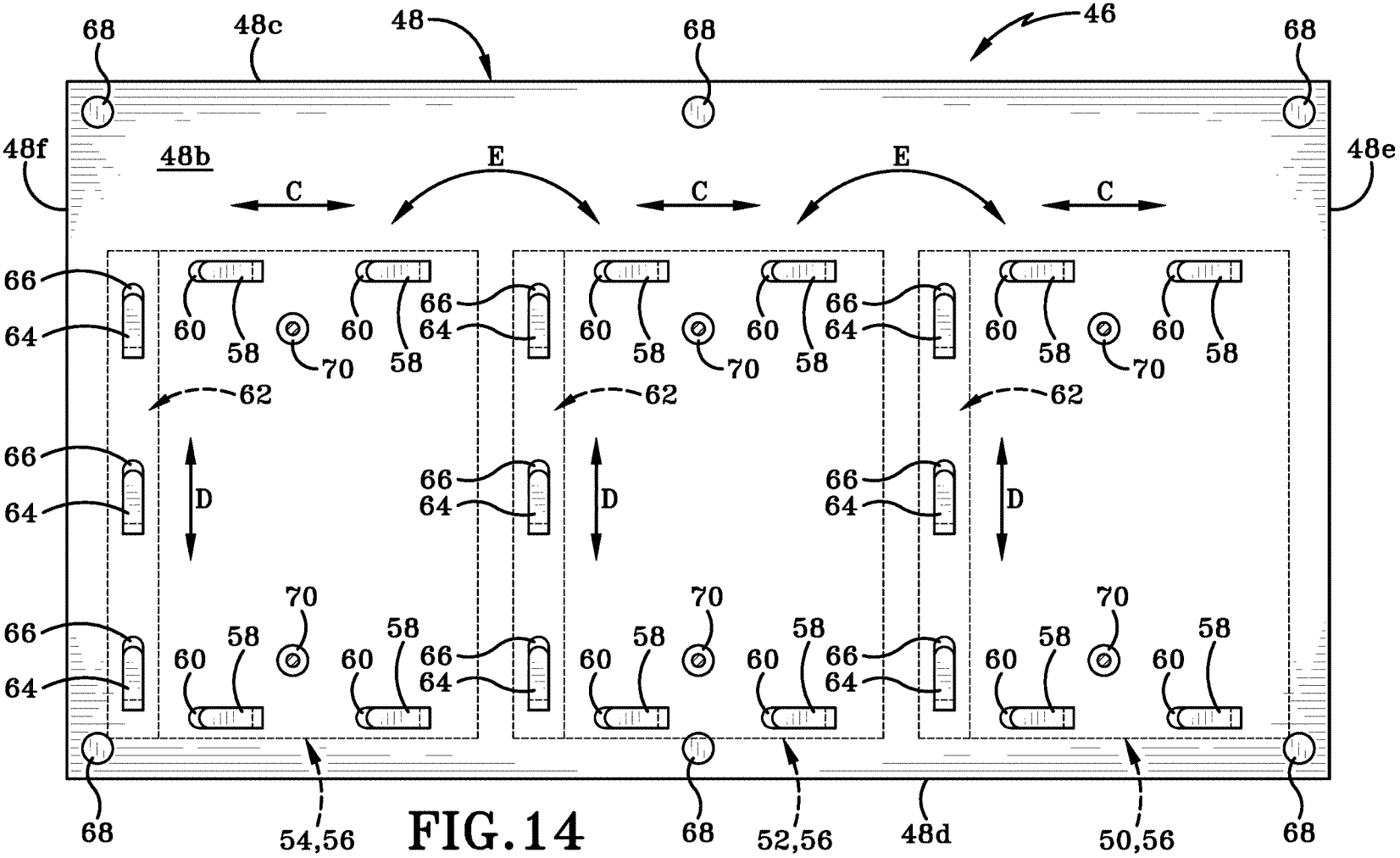
FIG. 14 is a rear elevational view of the display sign rover of FIG. 13.

FIGS. 13 and 14 show a display system 46 comprising a plate member 48 having a front surface 48*a*, a rear surface 48*b*, a top edge 48*c*, a bottom edge 48*d*, a left side edge 48*e* and a right side edge 48*f*. A plurality of display sign assemblies 50, 52, 54 are engaged with plate member 48 in a substantially identical manner to the way in which signs 16-26 are engaged and secured to base plate 14. Each assembly 50-54 is substantially identical to assembly 10 and is comprised of a plurality of signs engaged with and latched to a base plate. The base plates, identified in FIGS. 13 and 14 by the reference number 56 have a plurality of bosses 58 that extend outwardly from their rear surfaces. The bosses 58 are received through apertures 60 defined in the plate member 48. Base plate 56 is then moved laterally relative to plate member 48 (indicated by arrow "C" in FIG. 14) and locking members 62 are engaged with plate member 48 to secure base plates 56 to plate member 48. Locking members 62 are substantially identical in structure and function to locking members 28 and include a plurality of bosses 64 extending outwardly from a rear surface thereof. Bosses 64 are inserted into apertures 66 defined in plate member 48. Locking members 62 slide downwardly towards bottom edge 48*d* to be locked in place to plate member 48 and slide upwardly toward top edge 48*c* to unlock. The locking and unlocking motions of locking members 62 are indicated by arrows "D" in FIG. 14.

Base plates 56 may be swapped around on plate member 48 by disengaging two or more base plates 56 and moving them to the desired new position on plate member 48. This swapping motion is indicated by arrows "E" on FIG. 14.

Plate member 48 may also include rubber stops 68 and mountings 70 similar in structure and function to stops 34 and mountings 32.

It will be understood that the shape of the base plate 14, signs 16-26; locking member 28, plate member 48, base plates 56, and the signs, and locking members 62 thereon may be changed to be other than rectangular. Any desired shape, size and number of these components may be changed. Additionally, the shape of bosses 40 and 64 and the complementary apertures 14*h*, 14*j*, 56, 48, 64, 66 that receive them may be changed to something different from what is illustrated in the attached figures. Such variations of shape and size may be embraced in order to give a different aesthetic appeal to the system.

It will further be understood that instead of providing the bosses on the signs 16-26 and locking member 28 and the apertures 14*h*, 14*j* on base plate 14; the apertures may be provided on signs 16-26 and locking member 28; and the bosses may be provided on the front surface of base plate 14.

It will further be understood that instead of the signs 16-26 being horizontally oriented and the locking member 28 being vertically oriented; the signs 16-26 may be vertically oriented and the locking member 28 may be horizontally oriented. It will also be understood that it is possible to orient the signs and locking member at different orientations and angles (other than horizontal and vertical) on base plate 14 from those shown herein. Any desired orientation and configuration of signs and locking member(s) may be utilized on base plate 14.

Furthermore, base plate may comprise a permanent section of support surface 12 instead of be a separate component that is secured to the wall. If base plate 14 is an integral part of support surface 12, then the selected one of the apertures or bosses (or apertures and bosses) may be integrally formed with support surface 12 and the mating complementary bosses and apertures will be found on the signs 16-26.

In summary, signage assembly 10 is used in the following manner. The method of displaying a sign 16-26 comprises providing a signage system 10 comprising a base plate 14 and a sign 16-26 for display; wherein one of base plate 14 and sign 16-26 has a boss 40 that extends outwardly therefrom and the other of base plate 14 and sign 16-26 defines an aperture 14*h* therein and through which boss 40 is able to pass; mounting base plate 14 on a support surface 12; inserting boss 40 into aperture 14*h*; moving sign 16-26 relative to a front surface 14*a* of base plate 14; and latching sign 16-26 to base plate 40.

The method may further include locking the latched sign 16-26 to base plate 14. The step of locking the latched sign 16-26 to base plate 14 includes the steps of providing a locking member 28; wherein one of the locking member 28 and the base plate 14 has a locking boss 44 extending outwardly therefrom; and the other of locking member 28 and base plate 14 defines a hole 14*j* therein; engaging locking boss 44 in hole 14*j*; and moving locking member 28 relative to base plate 14 from an unlocked position to a locked position.

The step of latching sign 16-26 to base plate 14 may include causing a flange 44*b* on the boss 44 to overlap a portion 14*k* of a wall of base plate 14 that surrounds and defines aperture 14*j*. The method may further include the step of capturing the portion 14*k* of the overlapped wall in a gap (similar to gap 40*c*), where the gap is defined between the flange 44*b* and the wall from which the boss 44 extends.

The method may further comprise providing a second sign 16-26 that includes one of a second boss 40 or a second aperture 14*h* such that the second sign 16-26 is of a same configuration as the sign 16-26; moving the latched sign 16-26 from the latched position (such as sign 22 in FIG. 11) to the unlatched position (such as sign 22 in FIG. 8); withdrawing boss 40 from aperture 14*h*; disengaging sign (such as sign 22) from base plate 14; engaging the second sign (any of signs 16-20 and 24-26) with base plate 14; inserting second boss 40 on the second sign into aperture 14*h* or inserting boss 40 through the second aperture 14*h*; and moving the engaged second sign from an unlatched position to the latched position.

The method may further comprise providing a second sign that includes one of a second boss or a second aperture such that the second sign is of a same configuration as the sign; providing an additional boss or defining an additional boss on the base plate; orienting the second sign to a same orientation of the sign; inserting the second boss through the second aperture; moving the second sign relative to the base plate; and latching the second sign to the base plate.

The method may further comprise aligning a first end 38*e* of the second sign 16-20 or 24, 26 with a first end 38*e* of sign 22; providing a locking member 28; orienting locking member 28 so that locking member 28 is at right angles relative to the sign and the second sign; positioning locking member 28 proximate the first ends 38*e* of the sign and second sign 16-26; and moving the locking member 28 relative to base plate 14 from an unlatched position to a latched position. The method may further include preventing movement of the sign and the second sign 16-26 from the latched position to the unlatched position using the locking member.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A signage system comprising:

a base plate having a front surface and a rear surface;

a sign having a rear surface that is positionable adjacent the front surface of the base plate;

a boss extending outwardly from the rear surface of the sign or a front surface of the base plate;

an aperture defined in the other of the rear surface of the sign or the front surface of the base plate; wherein the boss is received in the aperture; and wherein the sign is moveable relative to the base plate between an unlatched position and a latched position; and when the sign is in the latched position the boss is not removable from the aperture; and a locking member that is selectively engageable with the base plate, wherein the locking member is movable between an unlocked position and a locked position; and when the locking member is in the locked position the sign is locked to the base plate; wherein the locking member has a front surface and a back surface; and the back surface is positionable adjacent the front surface of the base plate; and wherein the locking member further includes:

a boss extending outwardly from the back surface of the locking member or from the front surface of the base plate; and a hole defined in the other of the back surface of the locking member or the front surface of the base plate; and wherein the boss on the locking member is received in the hole; and wherein the locking member is moveable relative to the base plate between an unlatched position and a latched position; and when the locking member is in the latched position the boss thereon is not removable from the hole.

2. The signage system as defined in claim 1, wherein each boss includes a flange that extends outwardly therefrom; and wherein the flange extends over a section of the rear surface of the sign or the front surface of the base plate when the sign is moved to the latched position.

3. The signage system as defined in claim 1, wherein the locking member is oriented at right angles relative to an orientation of the sign.

4. The signage system as defined in claim 1, further comprising a mounting assembly that is adapted to secure the base plate to a support surface.

5. The signage system as defined in claim 1, wherein the boss and the aperture are complementary in size and shape.

6. The signage system as defined in claim 1, wherein the boss includes a first curved end and a second curved end; and wherein a flange extends outwardly from the boss and projects for a distance outwardly beyond the first curved end; and wherein the flange is spaced a distance away from a surface on the associated sign or base plate from which the boss extends; and wherein a gap is defined between the flange and the surface on the associated sign or base plate.

7. The signage system as defined in claim 6, wherein the gap is dimensioned so as to receive a portion of a wall on the other of the associated sign or base plate when the sign is moved to the latched position.

8. A signage system comprising:

a base plate having a front surface and a rear surface;

a sign having a rear surface that is positionable adjacent the front surface of the base plate;

a boss extending outwardly from the rear surface of the sign or a front surface of the base plate;

an aperture defined in the other of the rear surface of the sign or the front surface of the base plate; wherein the boss is received in the aperture; and wherein the sign is moveable relative to the base plate between an unlatched position and a latched position; and when the sign is in the latched position the boss is not removable from the aperture; and a locking member that is selectively engageable with the base plate, wherein the locking member is movable between an unlocked position and a locked position; and when the locking member is in the locked position the sign is locked to the base plate; wherein a plurality of signs are engageable with the base plate; and wherein the locking member is engageable to lock all of the plurality of signs to the base plate.

9. The signage system as defined in claim 8, wherein each boss includes a flange that extends outwardly therefrom; and wherein the flange extends over a section of the rear surface of the sign or the front surface of the base plate when the sign is moved to the latched position.

10. The signage system as defined in claim 8, wherein the locking member is oriented at right angles relative to an orientation of the sign.

11. The signage system as defined in claim 8, further comprising a mounting assembly that is adapted to secure the base plate to a support surface.

12. The signage system as defined in claim 8, wherein the boss and the aperture are complementary in size and shape.

13. The signage system as defined in claim 8, wherein the boss includes a first curved end and a second curved end; and wherein a flange extends outwardly from the boss and projects for a distance outwardly beyond the first curved end; and wherein the flange is spaced a distance away from a surface on the associated sign or base plate from which the boss extends; and wherein a gap is defined between the flange and the surface on the associated sign or base plate.

14. The signage system as defined in claim 13, wherein the gap is dimensioned so as to receive a portion of a wall on the other of the associated sign or base plate when the sign is moved to the latched position.

15. A method of displaying a sign; comprising:

providing a signage system comprising a base plate and a sign for display; wherein one of the base plate and the sign has a boss that extends outwardly therefrom and the other of the base plate and the sign defines an aperture therein and through which the boss is able to pass;

mounting the base plate on a support surface;

inserting the boss into the aperture;

moving the sign relative to a front surface of the base plate;

latching the sign to the base plate;

providing a locking member having a front surface and a back surface;

locking the latched sign to the base plate using the locking member; and wherein the locking further comprises:

positioning the back surface of the locking member adjacent the front surface of the base plate;

extending a boss outwardly from the back surface of the locking member or from the front surface of the base plate;

inserting the boss into a hole defined in the other of the back surface of the locking member or the front surface of the base plate; and moving the locking member relative to the base plate between an unlatched position and a latched position; wherein when the locking member is in the latched position the boss thereon is not removable from the hole.

16. The method as defined in claim 15, wherein the step of latching the sign to the base plate includes:

causing a flange on the boss to overlap a portion of a wall that surrounds and defines the aperture.

17. The method as defined in claim 16, further comprising:

capturing a portion of the overlapped wall in a gap defined between the flange and the wall from which the boss extends.

18. The method as defined in claim 15, further comprising:

providing a second sign that includes one of a second boss or a second aperture such that the second sign is of a same configuration as the sign;

moving the latched sign from the latched position to the unlatched position;

withdrawing the boss from the aperture;

disengaging the sign from the base plate;

engaging the second sign with the base plate;

inserting the second boss into the aperture or inserting the boss through the second aperture; and moving the engaged second sign from an unlatched position to the latched position.

19. The method as defined in claim 15, further comprising:

providing a second sign that includes one of a second boss or a second aperture such that the second sign is of a same configuration as the sign;

providing an additional boss or defining an additional boss on the base plate;

orienting the second sign to a same orientation of the sign;

inserting the second boss through the second aperture;

moving the second sign relative to the base plate;

latching the second sign to the base plate.

20. The method as defined in claim 19, further comprising;

aligning a first end of the second sign with a first end of the sign;

providing a locking member;

orienting the locking member so that locking member is at right angles relative to the sign and the second sign;

positioning the locking member proximate the first ends of the sign and second sign; and moving the locking member relative to the base plate from an unlatched position to a latched position.

21. The method as defined in claim 20, further comprising;

preventing movement of the sign and the second sign from the latched position to the unlatched position using the locking member.

22. A display sign assembly comprising:

a plate member having a front surface and a rear surface; where the rear surface is adapted to be positioned on a support surface;

a plurality of signage systems being selectively engageable on the front surface of the plate member; wherein each signage system comprises:

a base plate having a front surface and a rear surface;

a sign having a rear surface that is positionable adjacent the front surface of the base plate;

a boss extending outwardly from the rear surface of the sign or a front surface of the base plate; and an aperture defined in the other of the rear surface of the sign or the front surface of the base plate; wherein the boss is received in the aperture; and wherein the sign is moveable relative to the base plate between an unlatched position and a latched position; and when the sign is in the latched position the boss is not removable from the aperture; and wherein the plate member defines a plurality of apertures therein and the base plate of each signage system defines a plurality of bosses thereon; and wherein each signage system is latched to the plate member by inserting the plurality of bosses on the base plate thereof through the plurality of apertures defined in the plate member and then moving the base plate relative to the plate member to move the base plate from an unlatched position to a latched position.

* * * * *